US010954755B2

(12) United States Patent
Goodman

(10) Patent No.: US 10,954,755 B2
(45) Date of Patent: Mar. 23, 2021

(54) DOWNHOLE HIGH-IMPEDANCE ALTERNATOR

(71) Applicant: HALLIBURTON ENERGY SERVICES, INC., Houston, TX (US)

(72) Inventor: George D. Goodman, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 586 days.

(21) Appl. No.: 15/114,839

(22) PCT Filed: Mar. 4, 2014

(86) PCT No.: PCT/US2014/020399
§ 371 (c)(1),
(2) Date: Jul. 27, 2016

(87) PCT Pub. No.: WO2015/134001
PCT Pub. Date: Sep. 11, 2015

(65) Prior Publication Data

US 2016/0348478 A1 Dec. 1, 2016

(51) Int. Cl.
*E21B 41/00* (2006.01)
*E21B 4/04* (2006.01)

(52) U.S. Cl.
CPC ..... *E21B 41/0085* (2013.01); *E21B 4/04* (2013.01); *E21B 41/00* (2013.01)

(58) Field of Classification Search
CPC . E21B 4/00; E21B 4/02; E21B 47/122; E21B 4/04; E21B 41/0085; E21B 41/00
See application file for complete search history.

(56) References Cited

U.S. PATENT DOCUMENTS 4,677,367 A * 6/1987 Goodman ..... H02M 3/1563 323/222
5,255,179 A * 10/1993 Zekan ..... H02M 7/48 307/10.1
5,839,508 A 11/1998 Tubel et al.
6,239,996 B1 * 5/2001 Perreault ..... B60L 3/003 323/223
7,201,239 B1 4/2007 Perry
7,701,101 B2 * 4/2010 Al-Khayat ..... H02K 1/2793 310/179
8,033,328 B2 10/2011 Hall et al.
2002/0089866 A1 * 7/2002 Keim ..... H02J 7/0054 363/89
2003/0075997 A1 * 4/2003 Keim ..... B60L 11/1803 310/68 D (Continued)

OTHER PUBLICATIONS

PCT Search Report for PCT Application No. PCT/US2014/020399 dated Dec. 23, 2014.

(Continued)

*Primary Examiner* — Yong-Suk (Philip) Ro
(74) *Attorney, Agent, or Firm* — Locke Lord LLP

(57) ABSTRACT

System and method are disclosed for supplying downhole power using a high-impedance alternator. The system includes a high-impedance alternator coupled with a rectifier at its output terminals, and a current fed power converter coupled with the rectifier providing a regulated voltage to a downhole load.

10 Claims, 6 Drawing Sheets

(56) References Cited

U.S. PATENT DOCUMENTS

| | | | | |
|---|---|---|---|---|
| 2006/0022840 | A1* | 2/2006 | Spring | E21B 17/003 340/854.3 |
| 2010/0039074 | A1* | 2/2010 | Brand | E21B 41/0085 322/28 |
| 2010/0224356 | A1* | 9/2010 | Moore | E21B 4/02 166/65.1 |

OTHER PUBLICATIONS

PCT Written Opinion for PCT Application No. PCT/US2014/020399 dated Dec. 23, 2014.

* cited by examiner

DOWNHOLE HIGH-IMPEDANCE ALTERNATOR

TECHNICAL FIELD OF THE INVENTION

The embodiments disclosed herein relate to downhole power generation and provision and, more particularly, to a system and method for supplying downhole power by use of a high-impedance alternator.

BACKGROUND OF THE INVENTION

Many operations require a downhole electric power source during the course of drilling an oil or gas well. For example, a downhole power source is required to operate instruments that measure various drilling parameters, formation properties, bore geometry, and the like. Research and development efforts in the area continue to focus on downhole alternators as the preferred means for producing significant levels of local electrical power. The advantage of an alternator for local power generation has long been recognized, for example, in wireline, measurement while drilling (MWD), slickline, well completion, and similar applications. Both open-hole and cased-hole solutions normally require advanced downhole compatible alternators to convert mechanical energy to electric power, while MWD applications currently utilize mud-flow driven turbines for the energy conversion.

Conventional downhole alternator power systems involve a mud turbine that is coupled to an alternator that converts mechanical energy into electrical energy. Conventional downhole alternators are intentionally designed to provide minimum source impedance at their electrical terminals. This is considered advantageous because source resistance results in undesirable resistive heating and loss of efficiency. Source reactance also results in reduced voltage regulation for widely varying load conditions, as is often the case in downhole applications. Such low-impedance designs are a carryover from electric utility applications where machines are precisely controlled, producing the desired output voltage and frequency. Such precise control, however, is not feasible in downhole alternator power systems, which are powered from a mud flow or engine operating remotely in an uncontrolled and unpredictable downhole environment. MWD applications are further impacted by a wide range of mud flow rates and mud densities. As a result, conventional low-impedance alternators not only must be overdesigned to meet low current demands when operating at low speed, but also must be able to quickly accommodate high revolutions-per-minute (RPM) conditions as well.

Accordingly, a need exists for an improved downhole alternator power system and method therefor that can overcome the shortcomings and drawbacks of conventional downhole alternators.

BRIEF DESCRIPTION OF THE SEVERAL VIEWS OF THE DRAWING

For a more complete understanding of the disclosed embodiments, and for further advantages thereof, reference is now made to the following description taken in conjunction with the accompanying drawings in which.

DETAILED DESCRIPTION OF THE DISCLOSED EMBODIMENTS

The following discussion is presented to enable a person skilled in the art to make and use the invention. Various modifications will be readily apparent to those skilled in the art, and the general principles described herein may be applied to embodiments and applications other than those detailed below without departing from the spirit and scope of the disclosed embodiments as defined herein. The disclosed embodiments are not intended to be limited to the particular embodiments shown, but is to be accorded the widest scope consistent with the principles and features disclosed herein.

Figure 1:
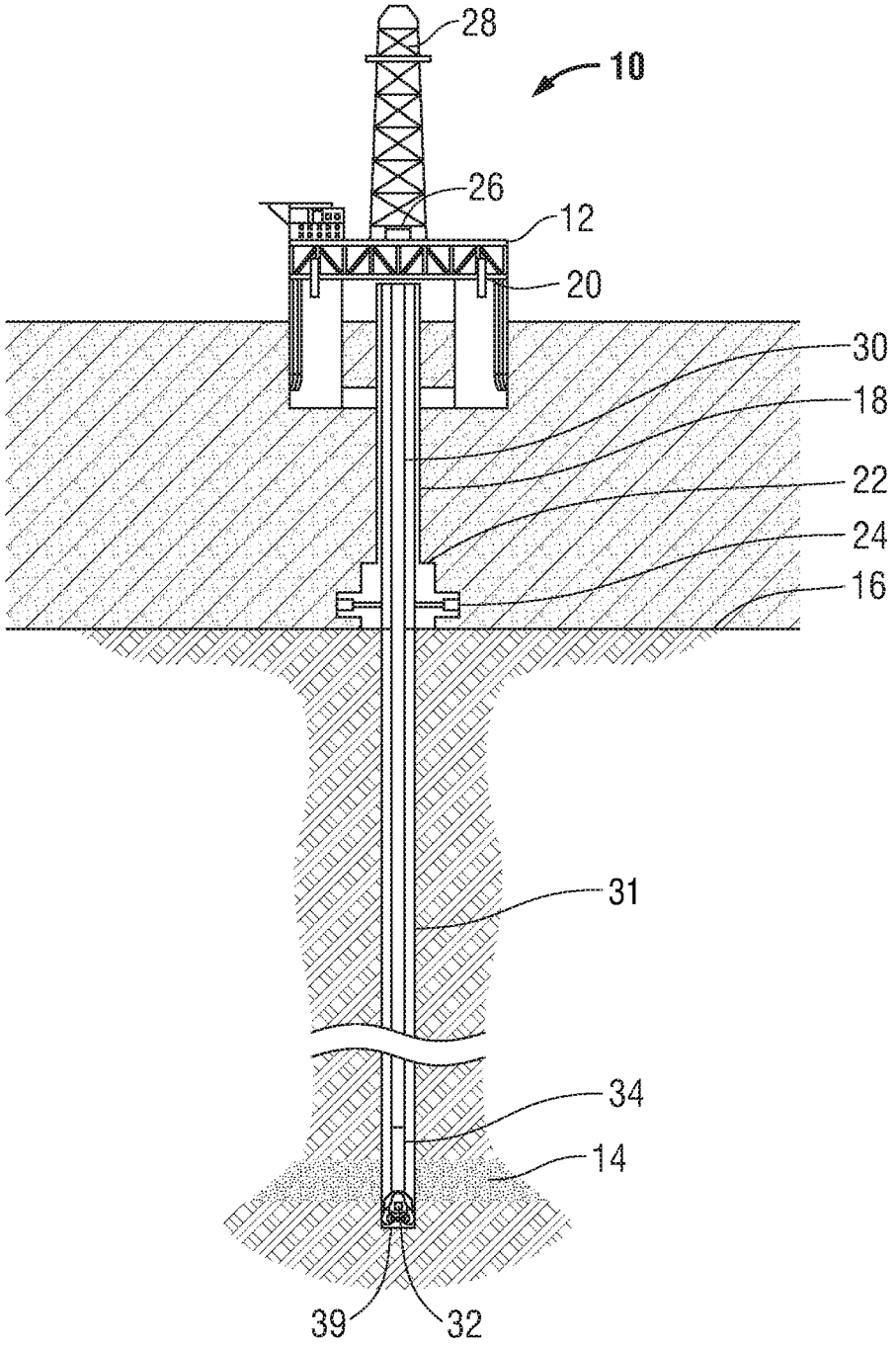
FIG. 1 illustrates a schematic diagram of an offshore oil or gas drilling platform including a downhole high-impedance alternator according to the disclosed embodiments.

Referring to FIG. 1, a schematic diagram of an offshore oil or gas drilling structure 10 including a downhole high-impedance alternator according to the disclosed embodiments is illustrated. The offshore drilling structure 10 includes a semisubmersible drilling platform 12 centered over a submerged oil or gas formation 14 located below sea floor 16. A subsea conduit 18 extends from a deck 20 of the platform 12 to a well head installation 22 including blowout preventors 24. The platform 12 has a derrick 28 and a hoisting apparatus 26 for raising and lowering a drill string 30 through a wellbore 31 formed in the oil or gas formation 14. The drill string 30 includes a drill bit 32 having tools and sensors 39 mounted thereon and installed therein requiring electric power to test or measure properties of the oil or gas formation 14. In accordance with the disclosed embodiments, the drill string 30 further includes a high-impedance alternator located within a section of the drill string 30 indicated generally at 34 that is electrically coupled to the tools and sensors 39 for providing the electric power needed by such tools and sensors 39.

It should be noted that although the high-impedance alternator is disclosed herein with respect to the tools and sensors 39 on the drill string 30 of an offshore oilrig 10 as shown in FIG. 1, those having ordinary skill in the art understand the high-impedance alternator is not so limited. For example, the high-impedance alternator may also be incorporated into a probe that is inserted in the conduit 18 or the drill string 30, or used with conventional onshore drilling rigs or in other onshore and offshore drilling operations. In general, the disclosed downhole high-impedance alternator may be used in any number of well service operations where electrical power is needed downhole.

Figure 2:
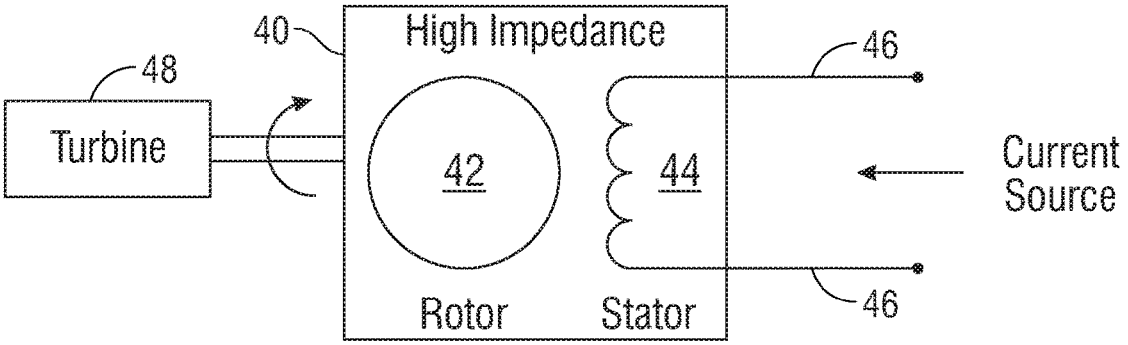
FIG. 2 illustrates a block diagram of a downhole high-impedance alternator used in FIG. 1 according to the disclosed embodiments.

FIG. 2 is a functional diagram of an exemplary high-impedance alternator 40 according to the disclosed embodiments that may be used in the drilling structure 10 or similar downhole applications. As can be seen, the high-impedance alternator 40 resembles a typical alternator insofar as it has a rotor 42 coupled to a stator 44 and leads or terminals 46 for allowing the high-impedance alternator 40 to be connected to external components. The rotor 42 may contain one or more permanent magnets or it may contain field windings for forming one or more electromagnets, and is typically attached to and turned by a turbine 48 that is driven by drilling fluid, usually mud, pumped down through the drill string 30 in FIG. 1. Alternatively, instead of the turbine 48, the high-impedance alternator 40 may be turned by a downhole engine, as in the case of a wireline or well completion service. The stator 44 contains armature windings through which current induced by changing magnetic field of the rotor 42 may flow. Turning the rotor 42 generates the changing magnetic field around the stator 44, inducing voltage at the terminals 46 of the alternator 40. The armature windings of the stature 44 are typically made of copper or other suitably lossless material.

In accordance with the disclosed embodiments, the high-impedance alternator 40 has a sufficiently high-impedance so that it resembles a current source to any electrical component connected to its terminals 46. An example of a component that may be connected to the high-impedance alternator 40 is a shunt type regulator that is capable of controlling the current provided by the alternator 40 to output a regulated output voltage. Shunt type regulators are well known in the art and will be described only briefly here. In general, such regulators comprise a shunt switch, an output filter section, and a control section configured to open and close the switch at a frequency that achieves a desired regulated output voltage. Each closing of the switch effectively short circuits the source and thus such regulators are normally applied only to high-impedance sources, as they tend to produce only small variations in source current even over a wide range of source voltages. When applied to the high-impedance source, the duty cycle of the shunt switch may be adjusted to ensure that it transfers to the load (i.e., with the switch open) only as much source current as is required to maintain a desired regulated output voltage. The balance of the current is shunted to ground on a time average basis (i.e., with the switch closed).

By using the high-impedance alternator 40, a number of benefits may be realized downhole over low-impedance alternators. For example, peak power efficiency may be achieved by power conversion equipment when operating under full load conditions and at the alternator's peak power operating point. Extended source operating power ranges and electrical load ranges due to, for example, wide variations in available power resulting from soft energy sources or changes in drilling mud weights and flow rates, may be more readily accommodated. Additional energy storage may be provided by virtue of the alternator's additional reactance, thus reducing the need for additional energy storage at the load. The additional energy storage in the alternator 40 may also provide improved step loading response. And as mentioned above, the high-impedance alternator 40 may be shunt regulated, allowing transient loading to be accommodated nearly instantaneously.

Improved power factor may result from the high-impedance alternator's inductive feed to a typical AC-to-DC conversion stage (i.e., less energy is lost through harmonic frequencies during rectification). As a result, the alternator's rating (Volt-Amp) and hence its required size may be reduced. Moreover, because loading of the alternator's mechanical drive shaft tends to be benign due to its ability to accommodate wide variations in available power, turbine or engine requirements may be simplified. Dynamic output loading is inherent by virtue of the large electrical reactance within the alternator 40, resulting in smooth mechanical shaft loading and improved system stability. System stability is further enhanced when the high-impedance alternator 40 is used to drive a current-fed power converter topology, such as a shunt regulator. Likewise, fault tolerance is inherent in the high-impedance alternator 40 in that open circuits and short circuits are well tolerated without fault propagation back through the mechanical power source, which might otherwise result in damage to equipment or create a safety hazard. This is because the high-impedance of the alternator 40 limits current to a safe value that is sustainable even at full operational speed without significant degradation. Further, because the increased impedance is predominately inductive reactance, the complex power generated when the alternator is shunt-regulated or the power system is overloaded is mostly reactive power, which circulates within the power system with only a moderate increase in alternator power dissipation and minimum mechanical loading of the turbine shaft.

To generate the high impedance of the high-impedance alternator 40, in one embodiment, an increased number of armature windings relative to alternators with low-impedances may be provided on the stator 44. In addition, or alternatively, the rotor 42 may be more loosely coupled to the stator 44 relative to low-impedance alternators. Techniques for determining the precise number of armature windings on the stator 44 and the specific proximity of the rotor 42 to the stator 44 needed for a particular implementation of the high-impedance alternator 40 are well known to those having ordinary skill in the art and will be described only briefly here with respect to FIG. 3.

Figure 3:
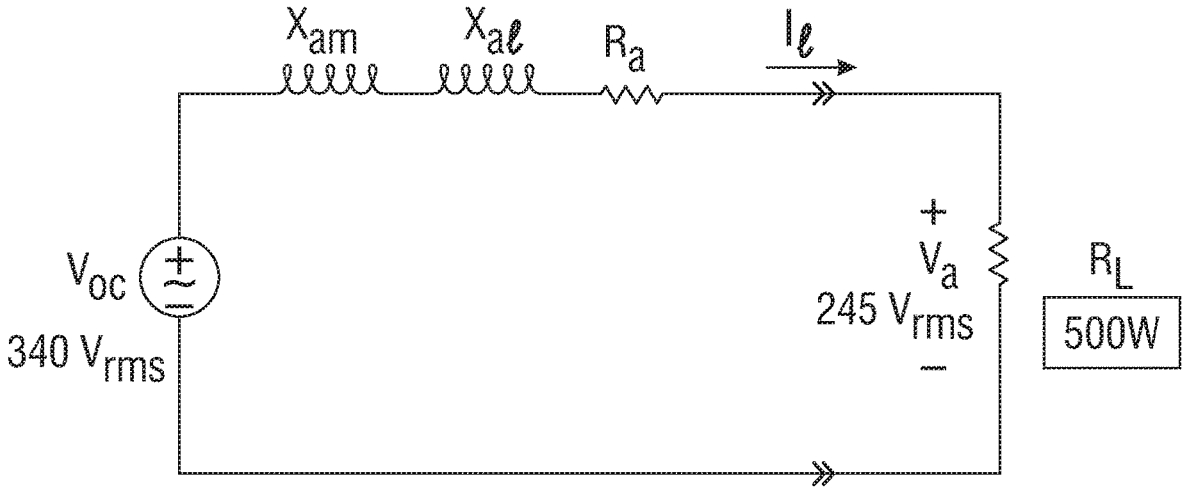
FIG. 3 illustrates a schematic diagram of an equivalent circuit of a single-phase high-impedance alternator.

As can be seen in FIG. 3, a single-phase high-impedance alternator 40 may be represented as an equivalent circuit having armature reactance $X_{am}$, armature leakage reactance $X_{al}$, and armature resistance $R_a$. The load is represented as a load resistance $R_L$. Also depicted are the line current $I_1$, the induced or open circuit voltage $V_{oc}$, and the armature voltage $V_a$ supplied to the load. As mentioned above, guidelines for defining typical alternator parameters have been well defined and are known to those having ordinary skill in the art. In general, the high-impedance alternator 40 has a predefined minimum reactance and a predefined minimum resistance, where the minimum reactance is comprised of an armature reactance that is adequate to cause the alternator to emulate a current source over a given output voltage range, and the minimum resistance comprises an armature resistance that is a certain percentage of its reactance. For example, the minimum resistance may comprise an armature resistance that is approximately 1 percent of its reactance, or it may be some other suitable percentage deemed by those having ordinary skill in the art to be appropriate for a particular application.

In some cases, it may be useful to provide the resistance and reactance for the high impedance alternator 40 in per unit value, which is defined as the ratio of the actual value of the respective parameter divided by a common base impedance. This allows preliminary machine parameters to be defined prior to completing the detailed design. Rule of thumb quantities may be used as guidelines, and the per unit values are set as target ranges that are dependent on size and form-factor of the alternator. After defining the target values, the design process may then produce the required armature and rotor details.

In one exemplary implementation, the rule of thumb for the values of the reactance and resistance may be as follows: $X_{am}$—1.0 to 2.0 per unit; $X_{al}$—0.1 to 0.2 per unit; and $R_a$—0.01 per unit. Using the rule of thumb quantities, the parameters for an exemplary high-impedance alternator 40 may be calculated as follows, assuming a 500 Watt load ($P_0$). $R_L$ may first be calculated as shown below, where $V_{ln}$ is the line voltage for a 425 Volt three-phase power line, resulting in an $R_L$ of roughly 120 Ohms (Ω). The line current $I_1$ is therefore roughly 2 Amps RMS (root mean square).

$$R_L = \frac{(V_{in})^2}{P_0} = \frac{(425/\sqrt{3})^2}{500} = 120\Omega$$

This means peak power will be delivered when $X_{am}+X_{al}$ is approximately 120Ω. Assuming $X_{al}$ is about (0.1)*$X_{am}$, the results is $X_{am}$+(0.1*$X_{am}$)=120Ω, or $X_{am}$≈109Ω. Further, $R_a$ is preferably about (0.01 to 0.005)*$X_{am}$. Assuming $R_a$ is about (0.0075)*$X_{am}$, the result is $R_a$=(0.0075)*(109Ω)=0.82Ω. Since the magnitude of the alternator's reactance is equal to the load resistance, and since the alternator's reactance is out of quadrature with the load resistance, for the assumed fixed alternator's rotational velocity, the per phase open circuit voltage $V_{oc}$ may then be calculated as follows, resulting in a $V_{oc}$ of roughly 340 $V_{rms}$.

$$V_{oc}=\sqrt{2}*2*(120)=340V_{rms}$$

Figure 4:
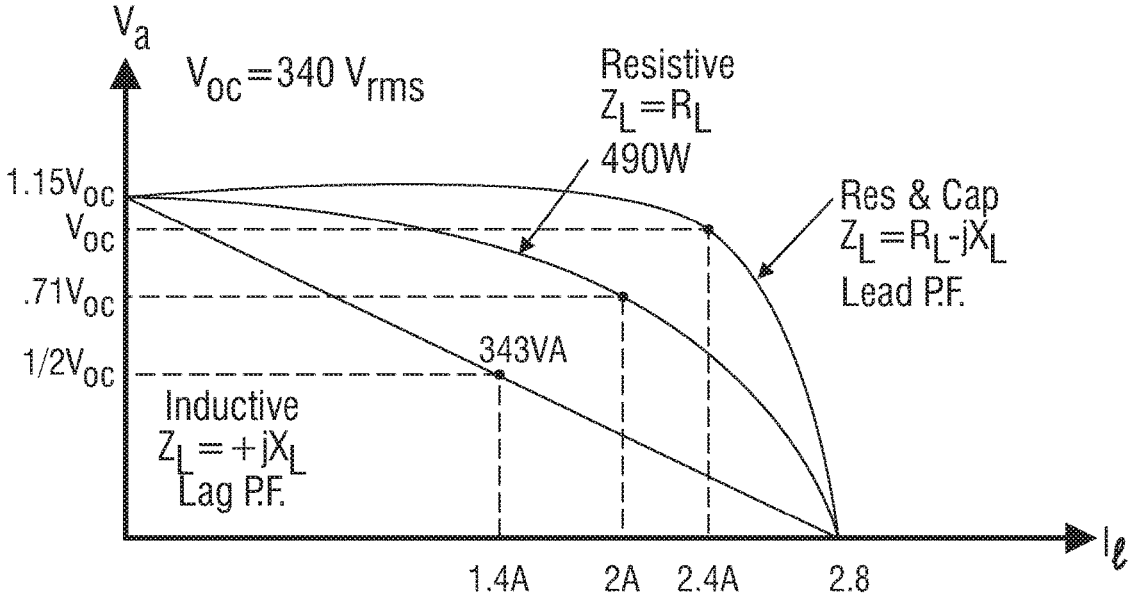
FIG. 4 illustrates a graph depicting the output voltage versus current characteristics of a high-impedance alternator with respect to various output resistive and reactive loading.

Turning now to FIG. 4, several loading curves are shown showing estimated reactive loading effects on the high-impedance alternator 40 depicted in FIG. 3, where the horizontal axis represents the line current $I_1$ and the vertical axis represents the armature voltage $V_a$. As can be seen, there are three curves representing the loading curves for a primarily inductive load, primarily resistive load, and primarily resistive and capacitive load, respectively. Whereas the inductive loading curve is substantially linear, the resistive loading curve is nonlinear, and the resistive and capacitive loading curve is significantly nonlinear Importantly, all three loading curves have nearly the same short circuit current, within 5-10 percent in some implementations, by virtue of the inherent ability of the high-impedance alternator 40 to limit current around a predefined value. This can provide significant benefit in downhole environments where extreme and unpredictable conditions can cause problems for electronic equipment.

As an example, in the downhole environment, a mud driven turbine is typically used to turn the rotor of the alternator. However, mud weight and/or flow rate may change due to drilling requirements, causing the rotor to turn at varying speeds. This may affect the performance of a conventional alternator used downhole since the output voltage of the alternator may change greatly with respect to the varying speed of the rotor. However, for a high-impedance alternator, in general, the open circuit voltage $V_{oc}$ and the armature reactance $X_{am}$ are proportional to the rotor speed. The short circuit current $I_{sc}$, on the other hand, is proportional to the ratio of the open circuit voltage $V_{oc}$ to the armature reactance $X_{am}$ (i.e., $|V_{oc}|/|X_{am}|$), meaning the short circuit current stays essentially constant with varying rotor speed. This allows the high-impedance alternator 40 to provide a relatively constant current despite variations on the rotor speed.

Figure 5:
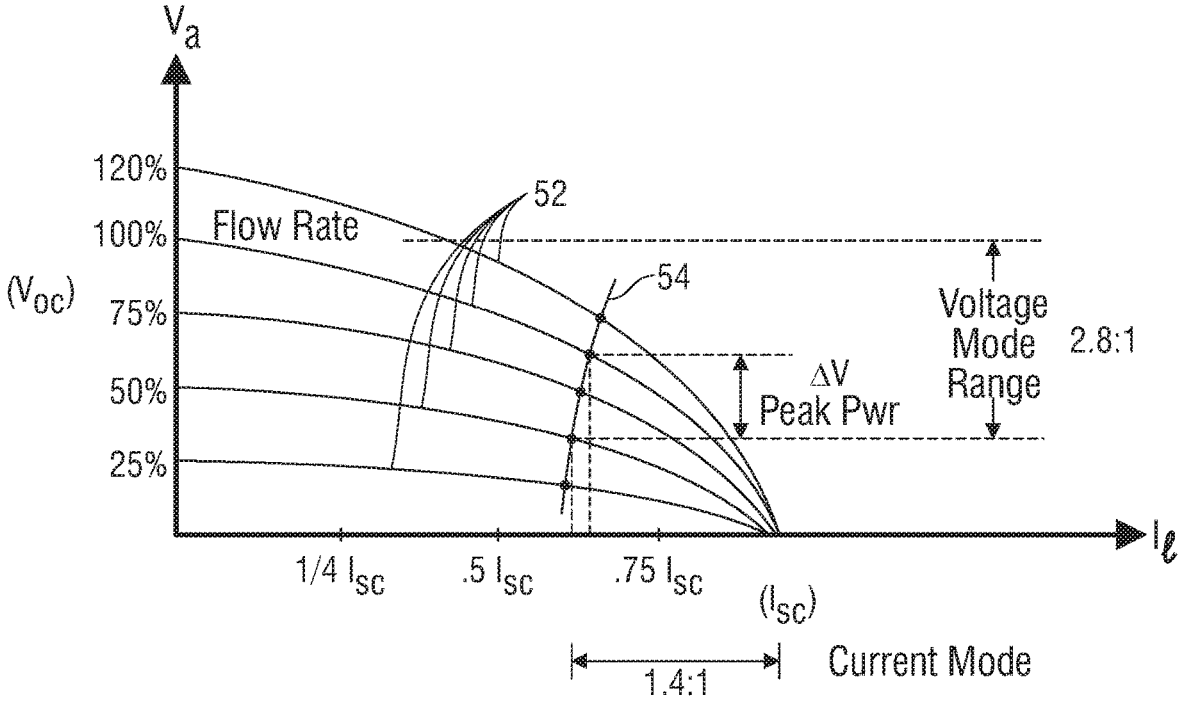
FIG. 5 illustrates a graph depicting the output voltage versus current characteristics of a high-impedance alternator with respect to various rotor speeds.

The foregoing is depicted in FIG. 5, which is a graph showing the output voltage-current characteristics of the alternator 40 with respect to various rotor speeds. Curves 52 show a family of loading curves with each one representing a constant shaft rotational velocity, and how the output voltages $V_a$ vary with the line current $I_1$. Peak power curve 54 depicts the peak power operating points for the loading curves 52. As the loading curves 52 show, when the rotor speed drops from 100% to 50%, resulting in a drop in the open circuit output voltage, the line current is only decreased by a small amount. That is to say, despite the great variation of the rotor speed, and consequently great variation of the output voltages, the high-impedance alternator 40 generates a relatively stable line current emulating a relatively stable current source. As can be seen, the 2 to 1 drop in rotor speed has resulted only in approximately a 1.4 to 1 change in current, but approximately a 2.8 to 1 change in voltage, or nearly double. In a similar manner, an alternator configured for voltage mode operation would produce a 2 to 1 output voltage variation, or greater.

Figure 6A:
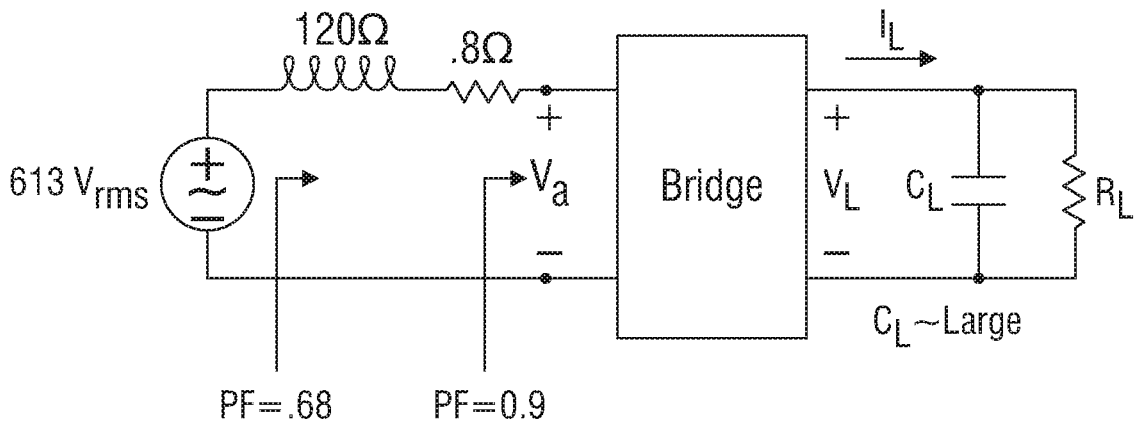
FIGS. 6A-6C illustrate another equivalent circuit of a high-impedance alternator configured with an AC-to-DC bridge rectifier and a capacitance input filter.

Moreover, the high-impedance alternator 40 is able to provide a high power factor at the terminals even when heavily loaded. FIG. 6A illustrates an equivalent circuit of the high-impedance alternator 40 where the alternator is heavily loaded. The high-impedance alternator 40 is shown here coupled with an AC-to-DC bridge rectifier and a capacitance input filter. With the parameters of the circuit set as shown in FIG. 6, the power factor PF of the alternator 40 can be calculated as shown below, where $P_{real}$ is the real power delivered to the load, $P_{apparent}$ is the power that is generated by the alternator and delivered to its output terminals but not dissipated in the load (i.e., $P_{apparent}$ is the magnitude of the complex power resulting from the real and imaginary power components generated within the alternator), and $I_p$ is the peak current. $P_{apparent}$ and $P_{real}$ can be expressed as follows, with $Q_{im}$ representing the reactive power generated in the alternator but not dissipated by the load:

$$P_{apparent} = \sqrt{P_{real}^2 + Q_{im}^2} = I_{L_rms} \cdot V_{L_rms}$$

$$P_{real} = V_L \cdot I_{average} = V_L \cdot \int_0^{\pi} \frac{I_P}{\pi} \cdot \sin(\theta) d\theta = \frac{2}{\pi} \cdot I_P \cdot V_L$$

$$P_{apparent} = V_L \cdot \frac{I_P}{\sqrt{2}}$$

Therefore, the power factor is calculated as shown below. As can be seen, the power factor of the high-impedance alternator 40 is approximately 90% even when heavily loaded.

$$PF = \frac{P_{real}}{P_{apparent}} = \frac{\left(\frac{2}{\pi} \cdot I_P \cdot V_L\right)}{\left(V_L \cdot \frac{I_P}{\sqrt{2}}\right)} = \frac{2 \cdot \sqrt{2}}{\pi} = 0.9$$

Figure 6B:
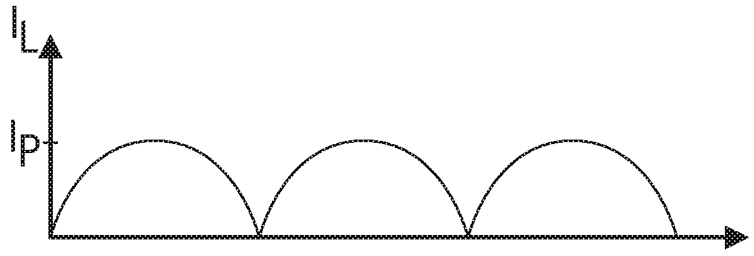
Figure 6C:
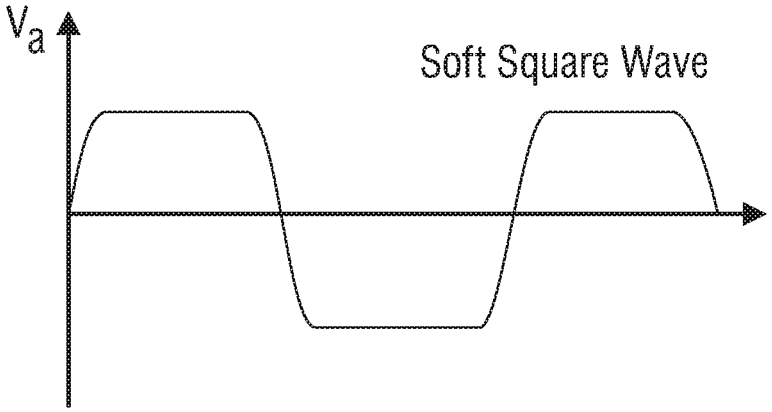

FIGS. 6B-6C show the waveforms for the line voltage $I_L$ and armature voltage $V_a$, respectively, for the high-impedance alternator 40. As can be seen, the high power factor PF results in an armature voltage $V_a$ that resembles a square wave with the softened corners.

Figure 7:
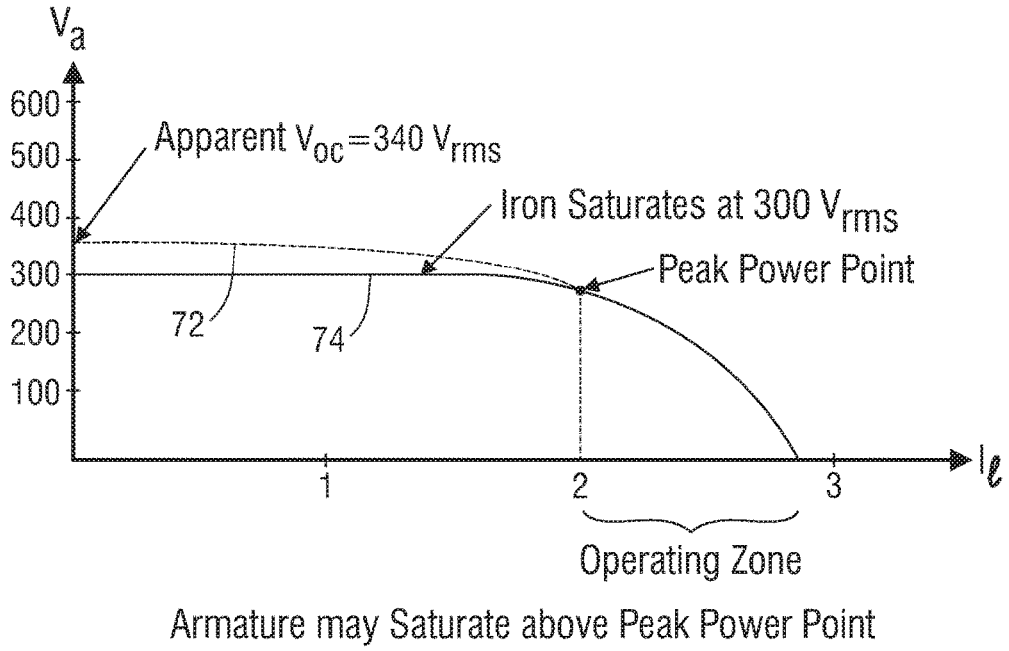
FIG. 7 illustrates a graph depicting the output voltage versus current characteristics of a high-impedance alternator designed to limit its open circuit voltage when lightly loaded.

An additional benefit of the high-impedance alternator 40 is that the armature voltage may be allowed to saturate for operation with electrical loading above the peak power point, as depicted in FIG. 7, where the horizontal axis again represents the line current the vertical axis represents the armature voltage. In general, for a given load, there is a point along the loading curve where peak power is being transferred to the load. As FIG. 7 shows, the normal operating region of the alternator 40 is at and above the peak power point current value. As a result, the armature iron need not be designed to support the higher flux density required to sustain the projected open circuit voltage. In FIG. 7, loading curve 72 (dashed line) represents an approximation of the loading curve for a given load when the armature voltage is approximately equal to the open circuit voltage of 340 $V_{rms}$, that is, when there is no armature saturation. When the load is removed, the armature may saturate, limiting the armature's open circuit voltage to 300 $V_{rms}$, as represented by loading curve 74 (solid line). As can be seen, even when the armature saturates in the high-impedance alternator 40, the saturation point of 300 $V_{rms}$ is above the peak power point voltage, meaning peak power will still be transferred to the load when the load is reapplied. That is to say, the high-impedance alternator 40 does not need to reach the open circuit voltage in order to provide peak power to the load.

In addition, all operating points along the loading curve 74 are available to the high-impedance alternator, including the area labeled "operating zone" that would not otherwise be available to a low-impedance alternator. This is because the high-impedance alternator can be operated with both an open circuit and a short circuit load (e.g., the load becomes damaged). With an open circuit load, no current flows and hence there is no power loss. With a short circuit load, the alternator will lose a small amount of power in the armature windings (copper losses), but not much more than that, and no damage to the alternator or other equipment up the line. The low-impedance alternator, on the other hand, is not able to tolerate a short circuit load, as a significant amount of current may flow through the alternator, leading to power loss, burning out the alternator, locking up the drive shaft, and damaging other equipment. Thus, the low-impedance alternator may be operated with an open circuit load and it may be loaded up to the peak power point, but loading it beyond the peak power point may result in a fault that may propagate up the line, potentially blocking the mud flow passage.

Figure 8A:
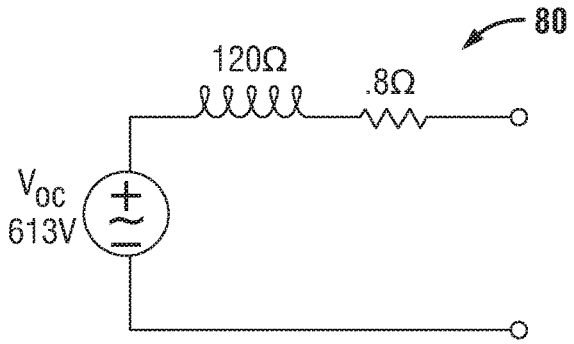
FIGS. 8A and 8B illustrates circuits diagrams of possible applications of the high-impedance alternator in a downhole environment.
Figure 8B:
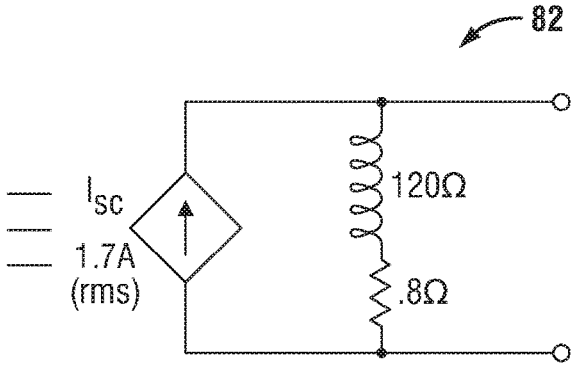
Figure 9:
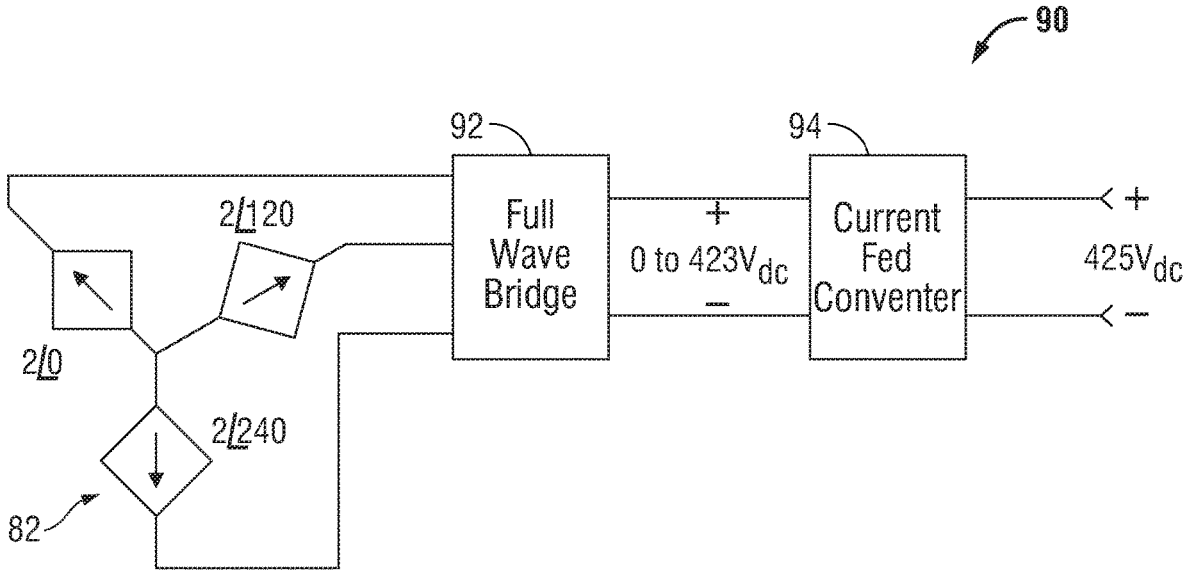
FIG. 9 illustrates an equivalent circuit of a three-phase high-impedance alternator that may be used in a downhole environment.

FIGS. 8A and 8B and FIG. 9 are circuits diagrams illustrating possible applications of the high-impedance alternator 40 in a downhole environment. FIG. 8A is a circuit representation of the high-impedance alternator as a single-phase voltage source 80, while FIG. 8B is the equivalent circuit representation of the high-impedance alternator has a single-phase current source 82. FIG. 9 illustrates the single-phase high-impedance current source representation 82 of FIG. 8B arranged to form a three-phase high-impedance current source 90. In a typical downhole application, the three-phase high-impedance alternator 90 may be coupled to a full wave bridge 92 that outputs a rectified or DC voltage to a current fed converter 94, which may be a shunt type converter. The current fed converter 94 thereafter provides a regulated output voltage to the load.

As discussed above, using high-impedance alternators in downhole environment for power supply has many advantages. Table 1 compares the performances of a high-impedance alternator (resulting in current fed loading) versus a low-impedance alternator (resulting in voltage fed loading) in a typical 400 Volts DC bus downhole application.

TABLE 1

| Characteristic | High-Impedance Alternator (current fed loading) | Low-Impedance Alternator (voltage fed loading) |
|---|---|---|
| Required input range (assuming 2:1 shaft speed range) | 1.4:1 | 2.8:1 |
| Step loading response | $I_{sc}$ on demand with overshoot | Time lag: $i(t) = 0 + \frac{1}{L}\int v dt$ |
| Power factor | approximately 85% or higher | 45% to 85% |
| Energy storage | Provided by alternator | Provided by capacitor banks |
| Converter efficiency (measured at peak power point) | 99% | 85% to 95% |
| System stability (assuming peak power operation) | Very good | May require Line Stabilizing Network capacitor bank |
| Alternator power loss (assuming output shorted) | Some armature winding loss, but all operating points are available | Cannot short circuit load |

As can be seen in Table 1, a high-impedance alternator provides better performance downhole compared to a low-impedance alternator with regard to a number of characteristics, such as the required input range, step loading response, power factor, energy storage, converter efficiency, and system stability. For example, assuming the alternator shaft speed downhole varies by a ratio of 2:1, the high-impedance alternator output would vary by only a 1.4:1 ratio, whereas the low-impedance alternator output would vary by a 2.8:1 ratio. Step loading response, which is important for certain telemetry equipment downhole, is also better in the high-impedance alternator. In the high-impedance alternator, the short circuit current $I_{sc}$ is available substantially on demand, whereas there is a time lag in the low-impedance alternator, as reflected by the following equation:

$$i(t) = 0 + \frac{1}{L}\int v dt.$$

Additionally, the power factor of the high-impedance alternator is approximately 85 percent or higher, whereas the power factor of the low-impedance alternator is approximately 45 to 85 percent. As a result, a reduction in overall machine size (form factor) of about 6 percent may be realized with the high-impedance alternator over the low-impedance alternator. Also, due to its higher inductance, the high-impedance alternator is able to store a portion of the energy storage for the load, whereas the low-impedance alternator does not store any of the energy for the load and hence additional capacitor banks are typically needed to provide energy storage for the load. As well, when operating at the peak power point, the high-impedance alternator has a higher converter efficiency, approximately 99 percent, by virtue of the converter directing substantially all the current to the load (i.e., converter shunting is off). By comparison the low-impedance alternator has a converter efficiency of about 85 to 95 percent because all the power delivered to the load must be processed by the power converter. System stability (at peak power point) is also better for the high-impedance alternator, as the low-impedance alternator requires a negative resistance converter, which may result in oscillations that require the use of a Line Stabilization Network (LSN). Finally, while the high-impedance alternator may experience some power loss due to the armature windings in a shorted load condition, all operating points are available as discussed above (see FIG. 7), making the high-impedance alternator extremely robust and fault-tolerant relative to the low-impedance alternator, which cannot be operated under short circuit conditions.

As set forth above, the embodiments disclosed herein may be implemented in a number of ways. In general, in one aspect, the disclosed embodiments relate to a system for supplying electric power to a downhole load in a wellbore. The system comprises a downhole high-impedance alternator supplying power to the downhole load, the downhole high-impedance alternator having a predefined minimum reactance and a predefined minimum resistance. The predefined minimum reactance and the predefined minimum resistance are sufficiently high to cause the high-impedance alternator to emulate a current source over a given output voltage range.

In some embodiments, the system may further comprise any one of the following features individually or any two or more of these features in combination: (a) a rectifier coupled with the downhole high-impedance alternator at the output terminals of the downhole high-impedance alternator and configured to rectify any output current provided by the high-impedance alternator; (b) a current fed converter coupled with the rectifier, the current fed converter providing a regulated output voltage to the downhole load; (c) the predefined minimum reactance of the high-impedance alternator is comprised of an armature reactance, the armature reactance being sufficiently high to cause the high-impedance alternator to emulate the current source over the given output voltage range; (d) the predefined minimum resistance of the high-impedance alternator comprises an armature resistance of a predefined percentage of an armature reactance; (e) the high-impedance alternator varies the output current by approximately 1.4:1 for an input shaft speed that has a variation of 2:1; (f) the high-impedance alternator has a power factor of approximately 85 percent or higher; (g) the downhole load requires energy storage and the high-impedance alternator provides a portion of the energy storage required by the downhole load; the high-impedance alternator provides a peak efficiency of approximately 99 percent when measured at a peak power point on a loading curve; (h) the high-impedance alternator includes a rotor generating a magnetic field and an armature having armature windings thereon, the armature saturating at a point on a loading curve of the high-impedance alternator that has an operating voltage value greater than an operating voltage of a peak power point on the loading curve; and (i) the high-impedance alternator is capable of normal operation under both open circuit and short circuit load conditions without causing damage to the high-impedance alternator or propagating the fault to other downhole equipment.

In general, in another aspect, the disclosed embodiments relate to a method for supplying electric power to a downhole load in a wellbore. The method comprises providing a high-impedance alternator down a borehole, the high-impedance alternator having a predefined minimum reactance and a predefined minimum resistance. The method also comprises coupling the high-impedance alternator with a rectifier at the output terminals of the high-impedance alternator, the rectifier configured to rectify any output current provided by the high-impedance alternator. The method further comprises coupling a current fed converter with the rectifier bridge, the current fed converter providing a regulated output voltage to the downhole load.

In some embodiments, the method may further comprise any one of the following features individually or any two or more of these features in combination: (a) configuring the high-impedance alternator such that the predefined minimum reactance comprises an armature reactance adequate to cause the alternator to emulate a current source over a given output voltage range; (b) configuring the high-impedance alternator such that the predefined minimum resistance comprises an armature resistance of a predefined percentage of its reactance; (c) for an input that has a variation of 2:1, the output current of the high-impedance alternator varies by approximately 1.4:1; (d) operating the high-impedance alternator with a power factor of approximately 85 percent or higher; (e) the downhole load requires energy storage, further comprising using the high-impedance alternator to provide a portion of the energy storage required by the downhole load; (f) operating the high-impedance alternator to provide a peak efficiency of approximately 99 percent when measured at a peak power point on a loading curve (g) the high-impedance alternator includes a rotor generating magnetic field and an armature having armature windings thereon, further comprising saturating the armature at a point on a loading curve of the high-impedance alternator that has an operating voltage value greater than that of the peak power point on the loading curve; and (h) operating the high-impedance alternator normally under both open circuit and short circuit load conditions without causing damage to the high-impedance alternator.

In general, in yet another aspect, the disclosed embodiments relate to a structure for drilling a subsurface formation. The structure comprises a drilling platform centered over the subsurface formation, a conduit extending from a deck of the drilling platform into a wellbore within the subsurface formation, and a hoisting apparatus installed on the drilling platform. The structure further comprises a drill string supported by the hoisting apparatus, the drill string having a drill bit and one or more tools or sensors mounted thereon, a high-impedance alternator mounted at a predefined location on the drill string, the high-impedance alternator having a predefined minimum reactance and a predefined minimum resistance, and a rectifier coupled with the high-impedance alternator at the output terminals of the high-impedance alternator and configured to rectify any output current provided by the high-impedance alternator. The predefined minimum reactance and the predefined minimum resistance are sufficiently high to cause the high-impedance alternator to emulate a current source over a given output voltage range.

In some embodiments, the method may further comprise any one of the following features individually or any two of these features in combination: (a) a turbine connected to the high-impedance alternator, the turbine configured to be driven by drilling mud pumped down the drill string, wherein the alternator is configured to prevent an electrical fault occurring on the one or more tools or sensors from propagating to the turbine, or a downhole engine connected to the high-impedance alternator and configured to drive the high-impedance alternator, wherein the alternator is configured to prevent an electrical fault occurring on the one or more tools or sensors from propagating to the downhole engine; (b) a current fed converter coupled with the rectifier, the current fed converter providing a regulated output voltage to the one or more tools or sensors mounted on the drill string, or a linear shunt regulator coupled with the rectifier, the linear shunt regulator providing a regulated output voltage to the one or more tools or sensors mounted on the drill string.

While particular aspects, implementations, and applications of the present disclosure have been illustrated and described, it is to be understood that the present disclosure is not limited to the precise construction and compositions disclosed herein and that various modifications, changes, and variations may be apparent from the foregoing descriptions without departing from the spirit and scope of the disclosed embodiments as defined in the appended claims.

What is claimed is:

1. A system for supplying electric power to a downhole load in a wellbore, comprising:

a downhole high-impedance alternator supplying power to the downhole load, the downhole high-impedance alternator having a reactance and a resistance;

wherein the reactance and the resistance are sufficiently high to cause the high-impedance alternator to emulate a current source over a given output voltage range; and wherein the high-impedance alternator is capable of normal operation under both open circuit and short circuit load conditions without causing damage to the high-impedance alternator or propagating the fault to other downhole equipment.

2. The system of claim 1, further comprising a rectifier coupled with the downhole high-impedance alternator at the output terminals of the downhole high-impedance alternator and configured to rectify any output current provided by the high-impedance alternator.

3. The system of claim 2, further comprising a current fed converter coupled with the rectifier, the current fed converter providing a regulated output voltage to the downhole load.

4. The system of claim 1, wherein the minimum reactance of the high-impedance alternator is comprised of an armature reactance, the armature reactance being sufficiently high to cause the high-impedance alternator to emulate the current source over the given output voltage range.

5. The system of claim 1, wherein the minimum resistance of the high-impedance alternator comprises an armature resistance of a predefined percentage of an armature reactance.

6. The system of claim 1, wherein the high-impedance alternator varies the output current by approximately 1.4:1 for an input shaft speed that has a variation of 2:1.

7. The system of claim 1, wherein the high-impedance alternator has a power factor of approximately 85 percent or higher.

8. The system of claim 1, wherein the downhole load requires energy storage and the high-impedance alternator provides a portion of the energy storage required by the downhole load.

9. The system of claim 1, wherein the high-impedance alternator provides a peak efficiency of approximately 99 percent when measured at a peak power point on a loading curve.

10. The system of claim 1, wherein the high-impedance alternator includes a rotor generating a magnetic field and an armature having armature windings thereon, the armature saturating at a point on a loading curve of the high-impedance alternator that has an operating voltage value greater than an operating voltage of a peak power point on the loading curve.

* * * * *